US006520252B1

(12) United States Patent
Bizzarro

(10) Patent No.: US 6,520,252 B1
(45) Date of Patent: Feb. 18, 2003

(54) HEAT EXCHANGER ASSEMBLY WITH CORE-REINFORCING CLOSURE BARS

(75) Inventor: Peter Bizzarro, Canton, CT (US)

(73) Assignee: Hamilton Sundstrand, Windsor Locks, CT (US)

( * ) Notice: Subject to any disclaimer, the term of this patent is extended or adjusted under 35 U.S.C. 154(b) by 0 days.

(21) Appl. No.: 10/036,726

(22) Filed: Dec. 21, 2001

(51) Int. Cl.[7] ..... F28F 3/02
(52) U.S. Cl. ..... 165/166; 165/906
(58) Field of Search ..... 165/166, 906

(56) References Cited

U.S. PATENT DOCUMENTS 3,247,899 A * 4/1966 Branch ..... 165/166
3,262,496 A * 7/1966 Bawabe ..... 165/166
3,265,129 A * 8/1966 Bawabe ..... 165/166
3,517,731 A * 6/1970 Rothman ..... 165/166
3,601,185 A * 8/1971 Rothman ..... 165/166
4,301,863 A 11/1981 Bizzarro

* cited by examiner

*Primary Examiner*—Leonard Leo
(74) *Attorney, Agent, or Firm*—Carlson, Gaskey & Olds

(57) ABSTRACT

A heat exchanger assembly includes a plurality of fluid flow pathways including fins. Closure bars associated with each of the layers have a core reinforcing portion. Each core reinforcing portion includes first and second reinforcing members with a modified flow passage between them. The example embodiments include modified flow passages with generally C-shaped cross sections. The reinforcing portions preferably extend toward a center of the heat exchanger core varying distances along the body of the core so that reinforcing material is concentrated near the ends of the core where deformation caused by heat stress is most likely to occur.

19 Claims, 3 Drawing Sheets

HEAT EXCHANGER ASSEMBLY WITH CORE-REINFORCING CLOSURE BARS

BACKGROUND OF THE INVENTION

This invention generally relates to plate-fin type heat exchangers. More particularly, this invention relates to a heat exchanger assembly having core-reinforcing closure bars.

Plate-fin type heat exchangers with various fluid flow patterns are well known. Typical arrangements include a core that comprises stacked layers of continuous corrugated fin elements. Each layer typically is mounted so that the channels formed by the fins in one layer are oriented relative to the channels formed by the fins in an adjacent layer so that fluid flow through the channels is in different directions. A parting sheet typically is placed between adjacent fin layers to maintain separation between alternate fluid flow paths. Top and bottom cover sheets typically are included at the ends of the heat exchanger core for structural support.

Conventional arrangements include closure bars mounted on the core sides that act as seals maintaining fluid flow in the desired direction through the channels.

One innovation in the design of closure bars is shown in U.S. Pat. No. 4,301,863, where extensions on the closure bars are provided to establish a spacing between the heat exchanger core and the locations where headers are welded to the closure bars. While such an arrangement has proven effective, those skilled in the art are always striving to make improvements.

One challenge facing designers of heat exchangers includes the competing interests between structural integrity and weight. Lightweight designs are particularly desirable for aircraft applications, for example. Utilizing less material or lighter weight materials, however, can be problematic if the structural integrity of the core is not sufficient to withstand the temperature extremes experienced by the heat exchanger. It has proven difficult to establish a heat exchanger design that withstands extreme temperatures, yet operates efficiently and does not weigh too much.

This invention addresses the need for an improved design by providing a heat exchanger assembly with closure bars that reinforce the core of the heat exchanger while minimizing the amount of additional weight compared to other designs. Additionally, the inventive arrangement strikes a balance between maximizing the efficiency of the heat exchanger while providing the desired enhanced structural integrity.

SUMMARY OF THE INVENTION

In general terms, this invention is a heat exchanger having core-reinforcing closure bars.

A heat exchanger assembly designed according to this invention includes a plurality of first fluid pathway layers that allow fluid to flow in a first direction through the assembly. A plurality of second fluid pathway layers allow fluid to flow in a second direction through the assembly. A parting sheet separates each of the fluid pathway layers. A plurality of first closure bars are associated with the first fluid pathway layers. The first closure bars have a solid surface that is operative to guide fluid through the first fluid pathways in the first direction. The closure bars have a reinforcing portion extending at least partially into the first fluid pathways. The reinforcing portion of each closure bar has first and second reinforcing members on opposite sides of a modified flow passage. The first and second reinforcing members are secured to corresponding ones of the parting sheets, respectively.

A second plurality of closure bars preferably is associated with the second fluid pathway layers. The second closure bars, like the first closure bars, preferably have a solid surface operative to guide fluid through the second fluid pathways in the second direction. A reinforcing portion of each second closure bar extends at least partially into the corresponding second fluid pathway. The reinforcing portions, in one example, have first and second reinforcing members on opposite sides of a modified flow passage. The first and second reinforcing members are secured to corresponding ones of the parting sheets, respectively.

In one example, the closure bars and fluid pathways are oriented so that the two different directions of fluid flow through the exchanger assembly are perpendicular relative to each other.

In one example, the reinforcing portions modified flow passages have a generally C-shaped cross section. The reinforcing portions preferably extend in toward a center of the core in a direction perpendicular to the fluid pathways varying distances along the length of the core of the heat exchanger assembly. The reinforcing portions preferably extend further into the core near ends of the heat exchanger where deformation is more likely. Near the central portion of the heat exchanger, the reinforcing portions preferably extend less toward the center of the core. Having varying dimensions of the reinforcing portions, facilitates enhancing the structural integrity of the assembly while minimizing the amount of material weight.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
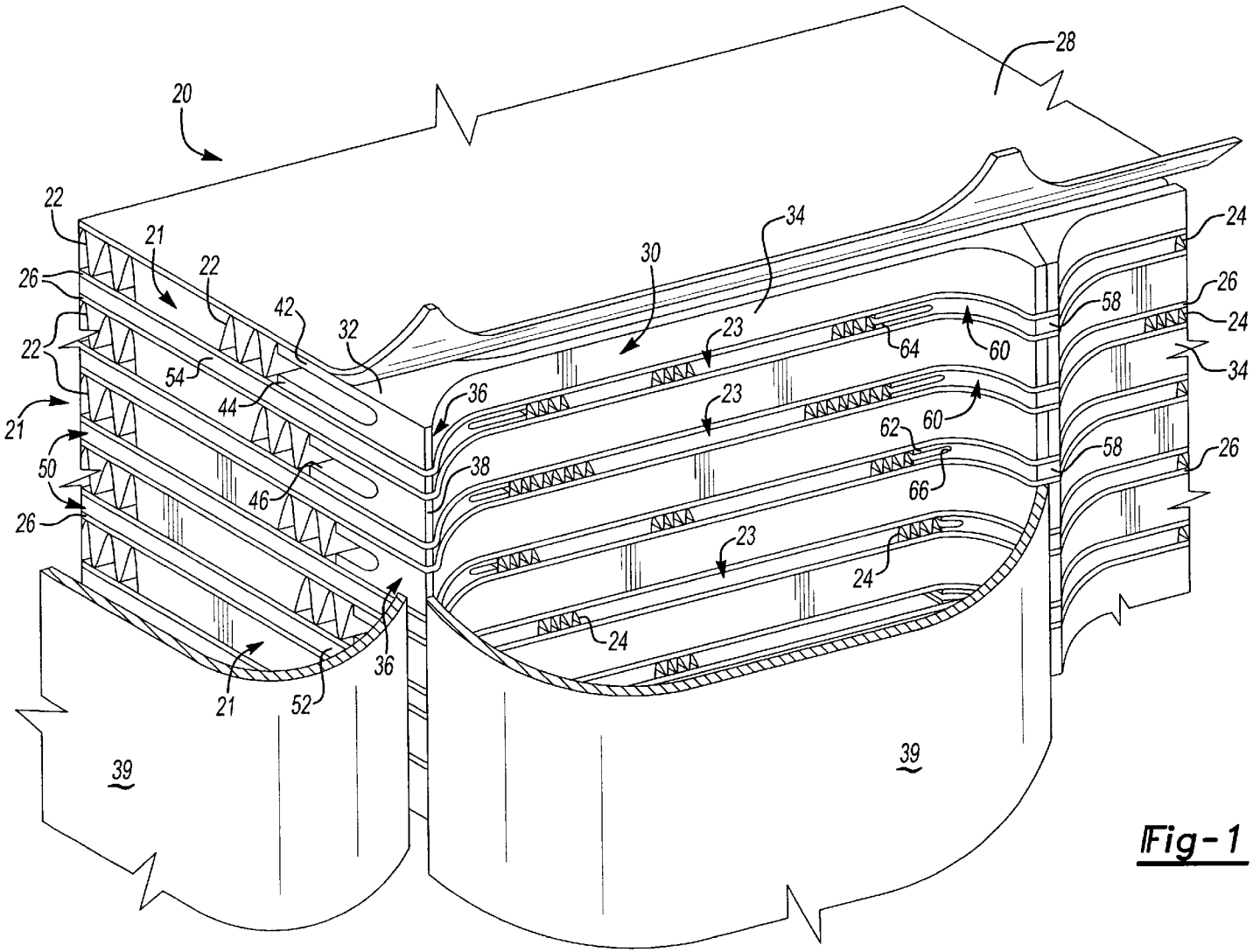
FIG. 1 illustrates a heat exchanger assembly designed according to this invention.

As schematically shown in FIG. 1, a heat exchanger assembly 20 includes a plurality of first fluid pathway layers 21 that allow fluid flow in one direction through the assembly. The first layers 21 include a plurality of corrugated-style fins 22 as known in the art. A plurality of second fluid pathway layers 23 allow fluid flow through the assembly in a second direction, which in the illustrated example happens to be perpendicular to the first direction. The second layers 23 include fins 24 as known in the art.

A plurality of parting sheets 26 preferably separate the fluid pathway layers. Cover sheets 28 preferably are included on the ends of the assembly 20. Only one cover sheet 28 is illustrated in FIG. 1. The fins 22, 24, parting sheets 26 and cover sheets 28 preferably are assembled using a brazing method as known in the art.

A plurality of first closure bars 30 are associated with the first fluid pathway layers 21 that include the fins 22. The first closure bars 30 include surfaces 32 that are adapted to be secured to the parting sheets 26 or a cover sheet 28, depending on the position of the particular layer that a particular closure bar 30 is associated with. A second surface 34 on the closure bars 30 establishes a seal that is operative to guide fluid through the first fluid pathways 21 in the selected direction. The surfaces 34 preferably extend parallel to the desired direction of fluid flow along the fins 22.

The closure bars 30 preferably include a header support section 36 including a welding surface 38 to which headers 39 can be secured using a conventional welding technique. The header supporting sections 36 preferably extend outward away from the body of the exchanger assembly core. Distancing the welding surfaces 38 from the fins 22 provides advantages when securing the headers 39 to the assembly 20.

The closure bars 30 include a core reinforcing portion 40. A first reinforcing member 42 is spaced from a second reinforcing member 44. The reinforcing members 42 and 44 preferably extend inward into the body of the core of the heat exchanger assembly 20. The reinforcing members 42 and 44 preferably are spaced apart from each other so that between them a modified fluid flow passage 46 is established to allow fluid flow in the first direction. In the illustrated example, the modified flow passage 46 has a generally C-shaped cross section. The reinforcing members 42 and 44 preferably are tapered relative to the surface 34 on the closure bars 30 so that the reinforcing members 42 and 44 have the greatest length adjacent the edge of the core of the assembly 20 at which fluid enters the flow pathway of the fins 22.

A plurality of second closure bars 50 is associated with the fluid pathways 23 having the fins 24. The closure bars 50 includes surfaces 52 that are adapted to be secured to the parting sheets in a conventional manner. Surfaces 54 provide a seal that operates to guide fluid flow along the fins 24 in the desired direction. In the illustrated example, the surfaces 54 on the closure bars 50 are perpendicularly oriented relative to the surfaces 34 on the closure bars 30.

Figure 2:
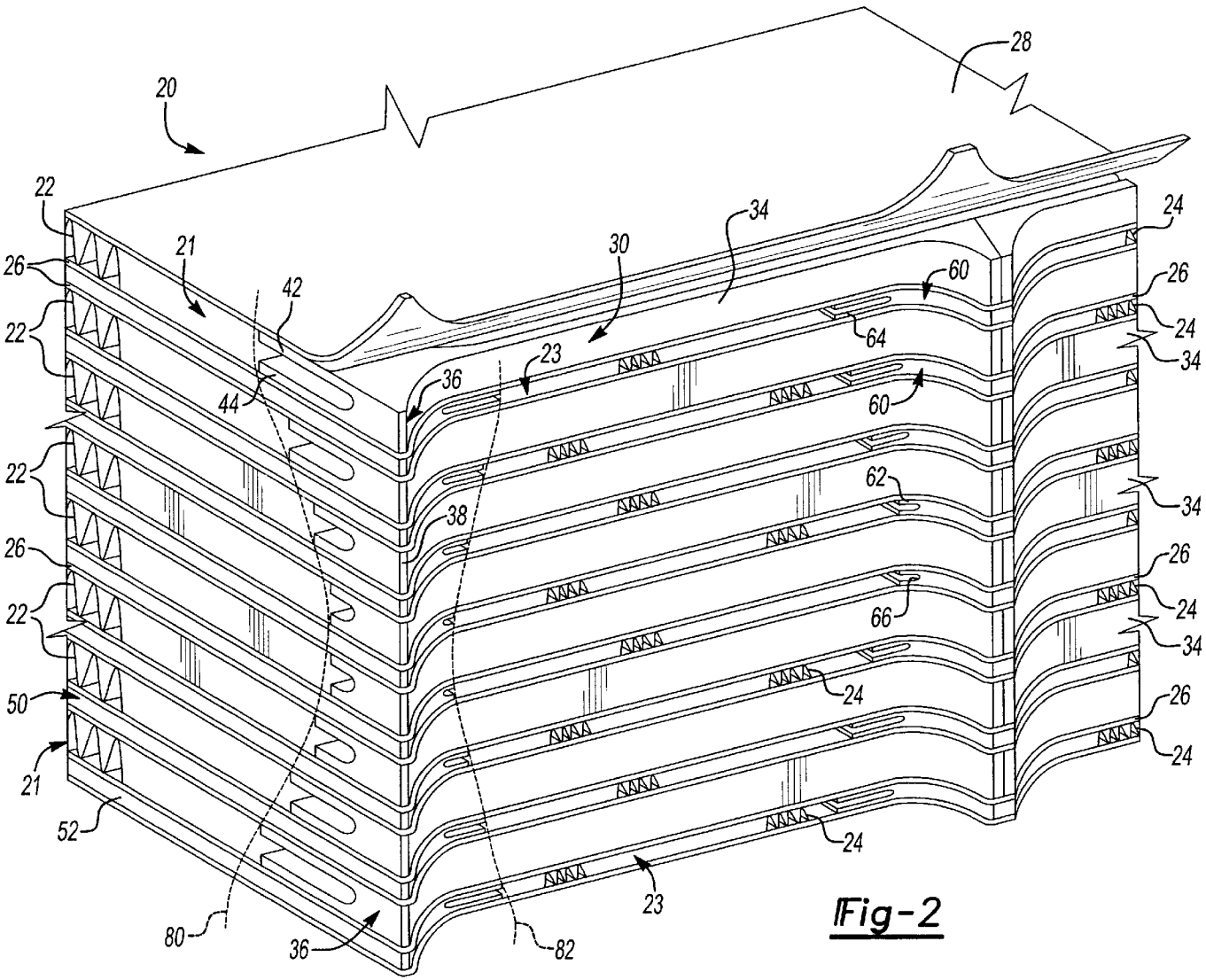
FIG. 2 illustrates, in somewhat more detail, selected features of the embodiment of FIG. 1.
Figure 3:
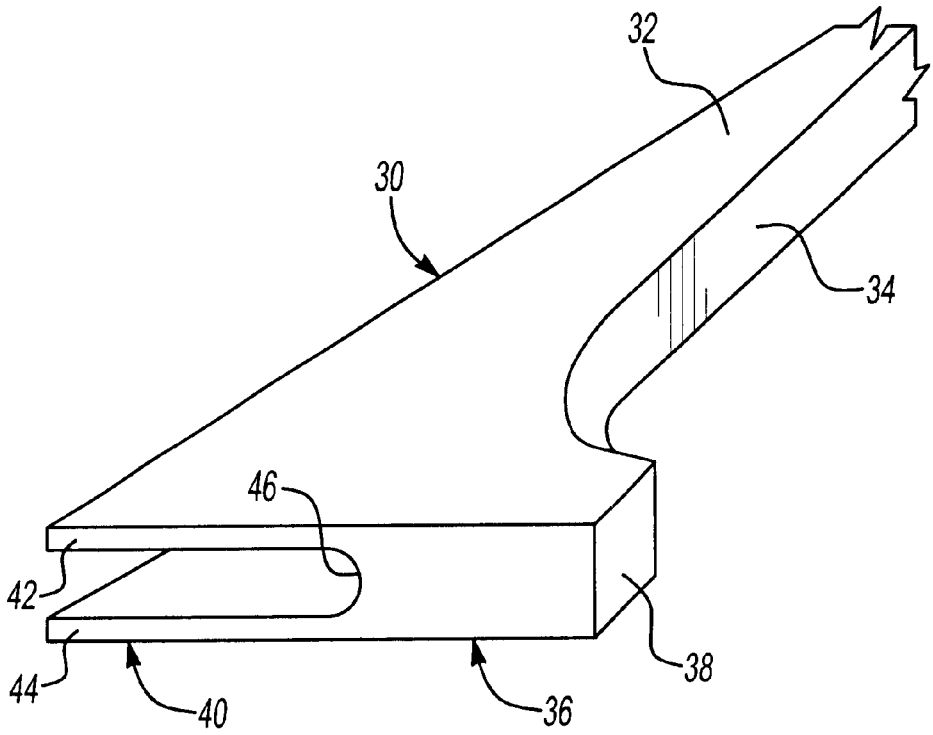
FIG. 3 schematically illustrates a closure bar designed according to this invention.

The closure bars 50 include a welding support portion 56 having a welding surface 58 to which the headers 39 can be welded in a conventional fashion. When the closure bars 50 and 30 are situated in the assembly 20, the welding surfaces 38 and 58 preferably are aligned and adjacent to each other establishing a welding surface along the entire length (i.e., from top to bottom in FIGS. 1 and 2) of the assembly 20.

The closure bars 50 include a core reinforcing portion 60 having reinforcing members 62 and 64. A modified flow passage 66 preferably is established between the reinforcing member 62 and 64. In the illustrated example, the modified flow passage 66 has a generally C-shaped cross section. Fluid flowing through the modified flow passage 66 preferably also encounters corresponding ones of the fins 24 as the fluid moves in the second direction through the second fluid pathways having fins 24.

Figure 4:
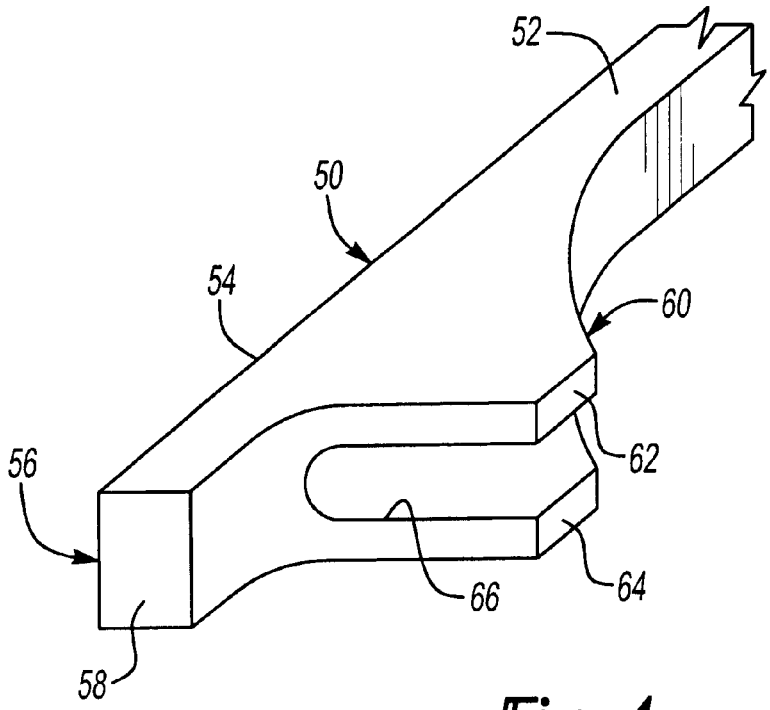
FIG. 4 illustrates another example closure bar designed according to this invention.

The reinforcing members 62 and 64 preferably extend toward a center of the core portion to provide reinforcing material at the corners of the core. The reinforcing member 62 and 64 preferably are tapered toward the surface 54 of the closure bars 50 as can be appreciated from FIG. 4, for example.

Including the reinforcing portions 40 and 60 on the closure bars provides greater stability and structural integrity to the heat exchanger core. The preferred arrangement includes a feature best appreciated from FIG. 2 where the illustrated example includes reinforcing portions having varying lengths along the core. Reinforcing portions near the ends of the core preferably are longer than those associated with layers that are closer to the center of the core. The closure bars 30, for example, preferably include reinforcing portions 40 that have a varying length along the core which follows a generally curved pattern illustrated in phantom at 80. A corresponding curve pattern 82 preferably is followed by the reinforcing portion 60 of the closure bars 50.

Utilizing shorter reinforcing portions at the layers that are near the center of the core compared to those associated with the layers near the ends of the core concentrates more material at locations where greater heat stress is likely to occur. Deformation of the core as caused by heat stress is more likely to occur near the ends (i.e., closer to the cover sheets 28) than is likely to occur at the center of the core. Therefore, this invention includes concentrating more reinforcing material at the portions of the core that are more likely to experience deformation as a result of heat stress. A variety of patterns may be used, depending on the configuration and dimensions of a particular heat exchanger. In one example, there is approximately a one-quarter inch difference in length of the reinforcing members of each reinforcing portion compared to the next layer. In one example, the longest reinforcing portion is approximately one inch while the shortest is approximately one-eighth of an inch. Given this description, those skilled in the art will be able to select appropriate dimensions and configurations to meet the needs of their particular situation.

The closure bars 30 and 50 can be formed using conventional molding, casting or extrusion processes, for example. One example includes using Inconal 625 high nickel content steel as the preferred material for forming the closure bars. This material is believed to have structural properties that provides the necessary amount of strength while keeping the weight of the assembly within desired limits.

This invention provides a number of advantages, including providing a more structurally stable core arrangement that does not have significantly higher weight compared to previous arrangements. Another advantage associated with the inventive arrangement is that the parting sheet thickness may be changed. The thickness of the parting sheets can be varied between $^{45}/_{1000}$ and $^{5}/_{1000}$ of an inch. The reinforcing portions of the closure bars provide added structural stability that allows for thinner parting sheet thicknesses to be used, which provides weight advantages.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A heat exchanger assembly, comprising:

a plurality of first fluid pathway layers that allow fluid to flow in a first direction through the assembly;

a plurality of second fluid pathways layers that allow fluid to flow in a second direction through the assembly;

a parting sheet separating each of the fluid pathway layers; and a plurality of first closure bars associated with the first fluid pathway layers, the first closure bars having a solid surface that is operative to guide fluid through the first fluid pathways in the first direction and having a reinforcing portion extending at least partially into the first fluid pathways, each reinforcing portion having a modified flow passage that allows fluid flow in the first direction, each reinforcing portion having two reinforcing members spaced apart from each other, a distal edge of the reinforcing members being spaced from the solid surface a varying distance along a length of the reinforcing members, a distance between the distal edges and the solid surface being greatest near one end of the reinforcing members.

2. The assembly of claim 1, including a plurality of second closure bars associated with the second fluid pathway layers, the second closure bars having a solid surface that is operative to guide fluid through the second fluid pathways in the second direction, the second closure bars having a reinforcing portion extending at least partially into the second fluid pathways, the reinforcing portions having a modified flow passage that allows fluid flow in the second direction.

3. The assembly of claim 2, wherein the first closure bars are perpendicularly oriented relative to the second closure bars.

4. The assembly of claim 2, wherein each second closure bar reinforcing portion has two reinforcing members spaced apart from each other, a distal edge of the reinforcing members being spaced from the solid surface a varying distance along a length of the reinforcing members, a distance between the distal edges and the solid surface being greatest near one end of the reinforcing members.

5. The assembly of claim 4, including a header attachment surface on each second closure bar and a concave transition between the header attachment surface and a portion of the reinforcing members that is aligned to face in the same general direction as the header attachment surface.

6. The assembly of claim 4, wherein the modified flow path has a varying depth along the length of the path.

7. The assembly of claim 1, wherein the reinforcing portions modified flow passages each have a generally C-shaped cross section.

8. The assembly of claim 1, wherein the reinforcing portions in one layer extend in a distance different than that of a next layer.

9. The assembly of claim 8, wherein the distance extending into the assembly is largest near ends of the assembly and the distance becomes increasingly smaller for the layers approaching a central layer of the assembly.

10. The assembly of claim 1, wherein the assembly includes headers and the closure bars have header supporting portions extending away from the pathway layers.

11. The assembly of claim 10, wherein the reinforcing portions are open at one end distal from the header supporting portions.

12. The assembly of claim 1, including fins in the pathways arranged relative to the closure bars such that fluid passing through the modified passages of the reinforcing portions passes over corresponding portions of the fins.

13. The assembly of claim 1, wherein the reinforcing portions each include reinforcing members on opposite sides of the modified flow passage.

14. The assembly of claim 1, including a header attachment surface near one end of the closure bar with a concave transition between the header attachment surface and the solid surface.

15. The assembly of claim 1, wherein the distal edges of the reinforcing members taper toward the solid surface in a direction into the assembly.

16. A closure bar for use in a heat exchanger, comprising:

a body having a first surface adapted to establish a seal and to direct fluid flow generally parallel to the first surface and a core reinforcing portion having first and second reinforcing members extending away from the first surface and spaced apart such that a flow passage exists between the reinforcing members, the reinforcing members having an edge distal from the first surface, the distal edge of the reinforcing members being spaced from the first surface a varying distance along a length of the reinforcing members, the distal edges being a greatest distance from the first surface near one end of the reinforcing members.

17. The closure bar of claim 16, including a header attachment surface near one end of the closure bar with a concave transition between the header attachment surface and the first surface.

18. The closure bar of claim 16, including a header attachment surface and a concave transition between the header attachment surface and a portion of the reinforcing members that is aligned to face in the same general direction as the header attachment surface.

19. The closure bar of claim 16, wherein the modified flow path has a varying depth along the length of the path.

* * * * *